US011905711B2

(12) United States Patent
Holman et al.

(10) Patent No.: US 11,905,711 B2
(45) Date of Patent: Feb. 20, 2024

(54) GUTTER CLEANERS AND METHODS ASSOCIATED THEREWITH

(71) Applicant: TECHTRONIC CORDLESS GP, Anderson, SC (US)

(72) Inventors: Christopher A Holman, Clemson, SC (US); Ronald J. Hoffman, Iva, SC (US)

(73) Assignee: Techtronic Cordless GP, Anderson, SC (US)

( * ) Notice: Subject to any disclaimer, the term of this patent is extended or adjusted under 35 U.S.C. 154(b) by 484 days.

(21) Appl. No.: 17/153,274

(22) Filed: Jan. 20, 2021

(65) Prior Publication Data

US 2021/0262236 A1 Aug. 26, 2021

Related U.S. Application Data

(60) Provisional application No. 62/979,032, filed on Feb. 20, 2020.

(51) Int. Cl.
*E04D 13/076* (2006.01)
*F04D 19/00* (2006.01)
(Continued)

(52) U.S. Cl.
CPC ..... *E04D 13/0765* (2013.01); *F04D 19/002* (2013.01); *F04D 25/0673* (2013.01); *F04D 27/004* (2013.01)

(58) Field of Classification Search
CPC ..... E04D 13/0765; F04D 19/002; F04D 25/0673; F04D 27/004; B08B 9/093
See application file for complete search history.

(56) References Cited

U.S. PATENT DOCUMENTS 4,121,320 A * 10/1978 Feiner ..... E04D 13/0765 15/406
4,168,559 A * 9/1979 Henson ..... A46B 13/04 15/23
(Continued)

FOREIGN PATENT DOCUMENTS

CA 2704417 C 8/2015
CA 2978279 A1 3/2019
(Continued)

OTHER PUBLICATIONS

European Search Report for EP Application No. EP21154976 dated May 28, 2021; 3 pages.
(Continued)

*Primary Examiner* — Aaron R Eastman
(74) *Attorney, Agent, or Firm* — Dority & Manning, P.A.

(57) ABSTRACT

A gutter cleaner comprising: a fan assembly; a guide configured to at least partially support the fan assembly on a gutter, wherein the guide comprises a skid configured to slide along the gutter; a handle coupled to the fan assembly at a location adjacent to a first axial end of the handle; and a battery port disposed at a location adjacent to a second axial end of the handle, the second axial end of the handle being opposite the first axial end of the handle, wherein the gutter cleaner is supportable via the handle by an operator located at an elevation below the gutter, and wherein the gutter cleaner has an approximately neutral operational buoyancy.

18 Claims, 7 Drawing Sheets

(51) Int. Cl.
*F04D 25/06* (2006.01)
*F04D 27/00* (2006.01)

(56) References Cited

U.S. PATENT DOCUMENTS 4,402,106 A * 9/1983 Mattson ..... E04D 13/0765 15/406
6,651,347 B2 11/2003 Uhl
7,743,683 B2 6/2010 Dayton
7,802,338 B1 9/2010 Hall
7,926,141 B2 * 4/2011 Dayton ..... E04D 13/0765 15/88.4
8,136,254 B2 3/2012 Gieske
8,418,898 B2 4/2013 Carlsson et al.
8,510,910 B1 8/2013 Ramsey
9,160,211 B2 10/2015 Tanimoto
9,267,291 B1 * 2/2016 Ramsey ..... E04D 13/0765
9,364,136 B2 6/2016 Devir
9,492,941 B2 11/2016 Mace
9,631,370 B2 4/2017 Paton
2001/0042284 A1 * 11/2001 Gutry ..... E04D 13/0765 15/144.4
2004/0107532 A1 * 6/2004 Murphy ..... A47L 9/02 15/405
2004/0143931 A1 * 7/2004 Dennis ..... A47L 5/14 15/405
2006/0213027 A1 9/2006 Oberembt
2008/0104780 A1 5/2008 Dayton
2008/0250570 A1 * 10/2008 Dayton ..... B25F 3/00 173/217
2013/0139332 A1 * 6/2013 Salahshor ..... A46B 5/0075 15/22.1
2015/0000070 A1 * 1/2015 Liu ..... A47L 9/0027 15/330
2017/0191272 A1 7/2017 Ashton-Miller
2017/0374760 A1 12/2017 Chen
2018/0045219 A1 2/2018 Li
2021/0254344 A1 * 8/2021 Holman ..... E04D 13/0765

FOREIGN PATENT DOCUMENTS

CN 204174847 U 2/2015
CN 106510570 A 3/2017
JP 2000352159 A 12/2000
WO WO2018162131 A1 9/2018

OTHER PUBLICATIONS

Canadian Office Action Corresponding to Application No. 3,107,821 dated Jun. 7, 2022 (1 page).

* cited by examiner

GUTTER CLEANERS AND METHODS ASSOCIATED THEREWITH

This application claims the benefit of priority to U.S. Provisional Patent Application No. 62/979,032, filed on Feb. 20, 2020, the disclosure of which is incorporated by reference herein in its entirety.

FIELD

The present disclosure relates to gutter cleaners, and more particularly to gutter cleaners that permit an operator to remain at a vertical elevation below the gutter during operation.

BACKGROUND

Gutters are frequently used to transport water from rooftops to downspouts or other water channeling means in order to prevent damage associated with excessive roof water runoff. In this regard, gutters are typically mounted on fascia or siding of buildings below the roofing shingles. Water can thus run from the shingles, into the gutters, and down adjoining downspouts.

Gutter efficacy requires properly arranged gutters and clear pathways for water movement. Clogs or restrictions can block water flow and reduce gutter efficiency. In heavy rain, clogged gutters can result in spillover, reducing gutter utility and potentially causing damage to underlying structures, such as housing foundation.

One particularly common way gutters become clogged is through trapped debris which collects over time. Exemplary debris includes leaves, branches, nuts, bird nests, and grains detached from overlying shingles. Leaves dropped by nearby trees during the months of fall are particularly troublesome and require annual, or even weekly, removal. Over time, debris compacts and hardens, further complicating gutter drainage.

Traditionally, debris is removed from gutters by hand. However, such removal process is dangerous and puts human life at risk. Further, it is sometimes impossible to adequately clean the gutters of debris by hand.

Accordingly, a device for easily and safely cleaning gutters is desired.

BRIEF DESCRIPTION

Aspects and advantages of the invention will be set forth in part in the following description, or may be obvious from the description, or may be learned through practice of the invention.

In accordance with one aspect, the present disclosure is directed to a gutter cleaning including a fan assembly configured to generate an airflow, a guide configured to support the fan assembly on a gutter, and a handle coupled to the fan assembly. The gutter cleaner is configured to be supported via the handle by an operator located at an elevation below the gutter.

In accordance with another aspect, the present disclosure is directed to a gutter cleaner configured to clean a gutter while the operator is located at an elevation below the gutter. The gutter cleaner defines an approximately neutral operational buoyancy. As described herein, an approximately neutral operational buoyancy may be achieved when the apparent weight of the gutter cleaner is approximately zero.

In accordance with another aspect, the present disclosure is directed to a method of cleaning a gutter with a gutter cleaner. The method includes positioning a fan assembly of the gutter cleaner adjacent to a gutter. The method further includes generating airflow with the fan assembly, wherein the gutter cleaner has an approximately neutral operational buoyancy in operation. The method further includes moving the gutter cleaner along a length of the gutter to blow debris therefrom.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
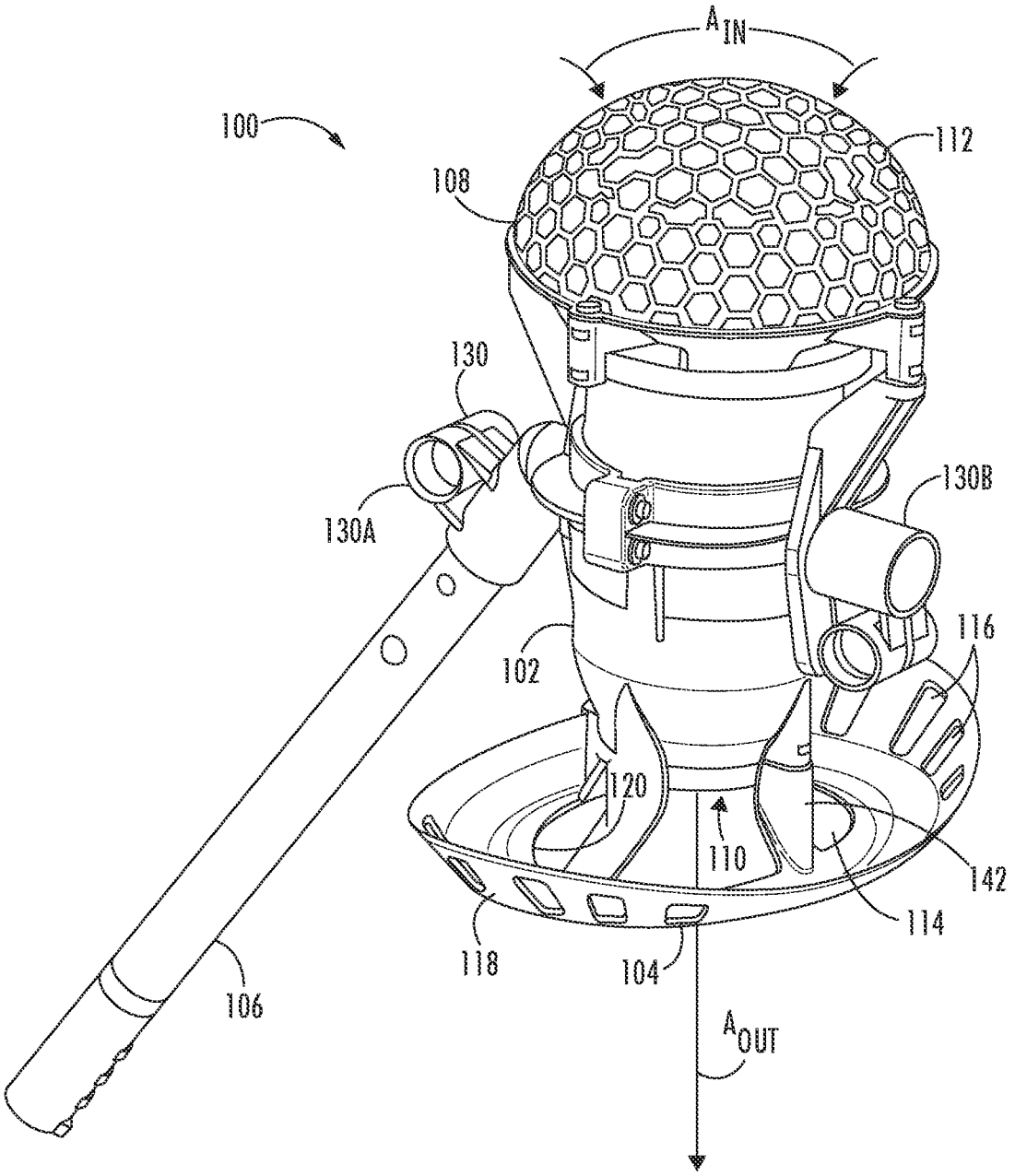
FIG. 1 includes a perspective view of a gutter cleaner in accordance with one or more embodiments described herein.

Reference now will be made in detail to embodiments of the invention, one or more examples of which are illustrated in the drawings. Repeat use of reference characters in the present specification and drawings is intended to represent the same or analogous features or elements of the present invention. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and do not necessarily signify sequence or importance of the individual components. As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Referring now to the Figures, the present disclosure is generally directed to gutter cleaners that allow an operator to more safely and efficiently remove debris from gutters. FIG. 1 illustrates a perspective view of an exemplary gutter cleaner 100 including a fan assembly 102, a guide 104, and a handle 106. The guide 104 can be coupled to the fan assembly 102, such as at a bottom location of the fan assembly 102. The handle 106 can be coupled to the fan assembly 102, such as at a location above the guide 106. Terms like "above," "below" and the like are used herein with reference to the orientation as illustrated in the figures. In another embodiment, the handle 106 may be coupled to the guide 104.

The fan assembly 102 is configured to generate output airflow, $A_{OUT}$, by drawing air, $A_{IN}$, through an air inlet 108 and biasing output airflow, $A_{OUT}$, through an exit port 110 in the fan assembly 102. The fan assembly 102 can be configured to generate airflow at a mass flow rate sufficient to generate thrust of at least 1 N, such as at least 2 N, such as at least 3 N, such as at least 4 N, such as at least 5 N, such as at least 10 N, such as at least 15 N during operation. In an embodiment, the fan assembly 102 can be configured to generate airflow at a mass flow rate of at least 0.15 kg/s, such as at least 0.2 kg/s, such as at least 0.25 kg/s. The fan assembly 102 can generate an airflow velocity of at least 30 m/s, such as at least 35 m/s, such as at least 40 m/s, such as at least 50 m/s. In a particular embodiment, the fan assembly 102 can be configured to generate a mass flow rate of at least 0.25 kg/s and an airflow velocity of at least 45 m/s, such as a mass flow rate of at least 0.3 kg/s and an airflow velocity of at least 50 m/s.

In certain instances, the fan assembly 102 can generate a fixed airflow. In other instances, the fan assembly 102 can have a variable speed to produce variable airflow rates. As described in greater detail herein, airflow generated by the fan assembly 102 can be used to clear debris from a gutter.

In an embodiment, the inlet 108 and exit port 110 are in axial alignment with one another, e.g., coaxial with respect to one another. The inlet 108 can include an inlet cover 112 disposed upstream of the fan assembly 102. The inlet cover 112 can define a plurality of openings 114 to permit air passage into the fan assembly 102. In an embodiment, the inlet cover 112 can define a porosity, as measured by a ratio [O:M] of open space, O, to material space, M, occupied by material of the inlet cover 112, of at least 1:20, such as at least 1:15, such as at least 1:10, such as at least 1:5, such as at least 1:1, such as at least 5:1, such as at least 10:1. In an embodiment, the inlet cover 112 can define a curved profile. For instance, the inlet cover 112 can include a domed profile. By way of example, the inlet cover 112 may be attached to the fan assembly 102 through one or more quick connections, threaded fastener(s), adhesive, hinge(s), lock(s), clip (s), threadable engagement, or any combination thereof. In the illustrated embodiment, the inlet cover 112 is secured to the fan assembly 102 through a plurality of fasteners, e.g., four threaded screws equidistantly spaced apart around the circumference of the fan assembly 102.

Figure 6:
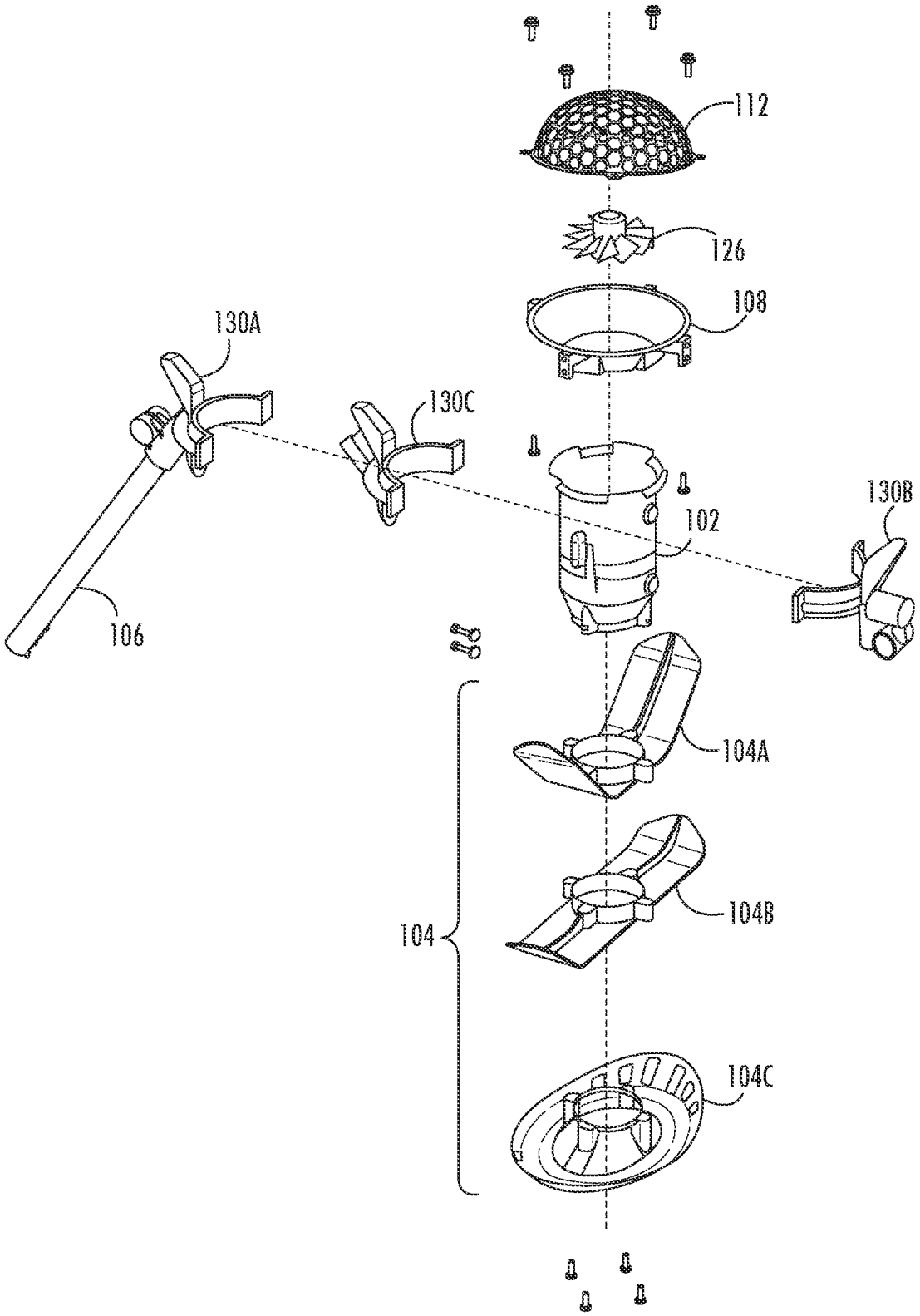
FIG. 6 includes an exploded perspective view of a gutter cleaner in accordance with one or more embodiments described herein.

The guide 104 can include a base portion 120 spaced apart from the exit port 110 of the fan assembly 102. In an embodiment, the guide 104 can be spaced apart from the fan assembly 102 by one or more stanchions 142 extending between the guide 104 and the fan assembly 102. Referring to FIG. 6, the guide 104 may be selectable between a plurality of interchangeable guides, e.g., guides 104A, 104B, and 104C. In this regard, an operator can select an appropriate guide 104 based on their specific intended use. For instance, the guide 104A may be particularly suitable for steep pitched roofs whereas guide 104B may be more suitable for minimally pitched roofs with wide gutters. Guide 104C may be more user friendly for beginners as it includes a lip 118 around the entire perimeter of the guide 104C. The operator can quickly detach a previous guide 104 and attach a new guide 104 to suite their needs. For example, in one or more embodiments, the guide 104 can be attached to the fan assembly 102, one or more stanchions 142, or other similar features of the gutter cleaner 100 through a quick connect interface.

Referring again to FIG. 1, the guide 104 can define a primary opening 114 through which airflow can be primarily biased by the fan assembly 102. The primary opening 114 of the guide 104 can be spaced apart from the exit port 110 of the fan assembly 102 and coaxially aligned therewith. In an embodiment, the primary opening 114 can define a diameter approximately equal to or larger than a diameter of the exit port 110. In certain instances, the gutter cleaner 100 can pass over one or more downspouts of the gutter system. In an embodiment, the gutter cleaner 100 may include an attachment (not illustrated) for the primary opening 114 which guides airflow into the downspout.

The guide 104 can further define a plurality of auxiliary openings 116 radially spaced apart from the primary opening 114 through which airflow can pass through. Output airflow, $A_{OUT}$, generally dissipates longitudinally and radially outward upon exiting the exit port 110. The auxiliary openings 116 can transmit radially-outward dissipated airflow to the underlying gutter instead of blocking the dissipated airflow as might occur in guides 104 without auxiliary openings 116. In an embodiment, the auxiliary openings 116 can reduce the weight of the gutter cleaner 100 while permitting a sufficiently large guide 104 to rest on the gutter as described hereinafter.

The guide 104 can have a tapered lip 118 at lateral edges to facilitate translation of the gutter cleaner 100 along underlying gutter structures. In an embodiment, the tapered lip 118 can have a curved, e.g., arcuate, interface with an underlying base portion 120 of the guide 104. That is, for instance, the base portion 120 and tapered lip 118 can meet at a smoothly transitioning interface. In another embodiment, the tapered lip 118 and base portion 120 of the guide 104 can form an angled interface. The tapered lip 118 may facilitate easier sliding of the gutter cleaner 100 along the gutter, preventing the guide 104 from catching on shingles, internal gutter fasteners or stays, gutter joints, extended siding, gutter guards, and the like.

Figure 2:
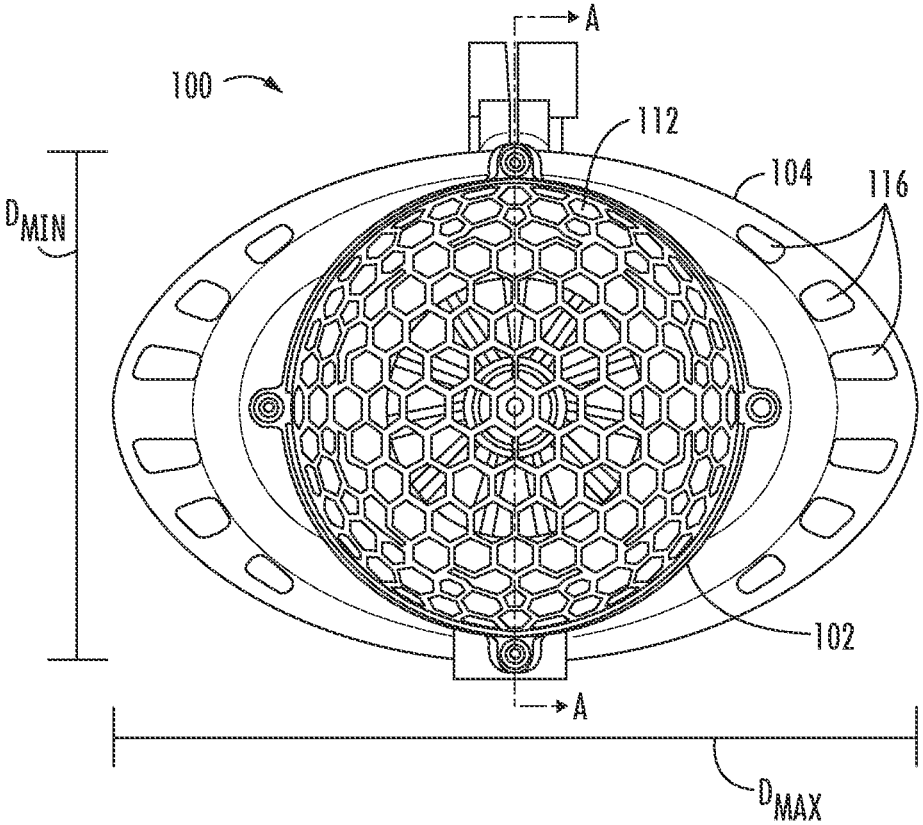
FIG. 2 includes a top view of a gutter cleaner in accordance with one or more embodiments described herein.

FIG. 2 illustrates a top view of the gutter cleaner 100 illustrated in FIG. 1. As illustrated in FIG. 2, the guide 104 can have a largest dimension, $D_{MAX}$, as measured from the top view, greater than a largest dimension of the fan assembly 102 or inlet cover 112. In an embodiment, $D_{MAX}$ can be greater than a maximum width of the gutter to be cleaned to prevent the gutter cleaner from falling in to the gutter. In another embodiment, the guide 104 can have a smallest dimension, $D_{MIN}$, as measured from the top view, greater than a largest dimension of the fan assembly 102 or inlet cover 112. In an embodiment, $D_{MIN}$ can be greater than the maximum width of the gutter to be cleaned. In such a manner, the gutter cleaner 100 can ride above the gutter while translating thereupon, as discussed in greater detail below.

Figure 3:
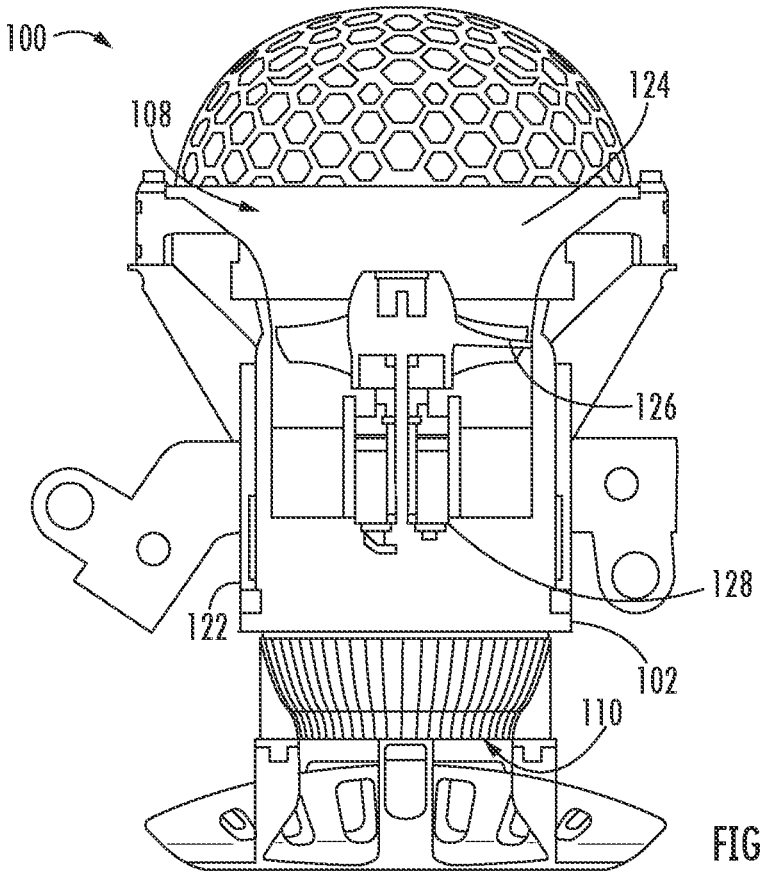
FIG. 3 includes a cross-sectional side view of a gutter cleaner in accordance with one or more embodiments described herein as seen along Line A-A in FIG. 2.

FIG. 3 illustrates a cross-sectional side view of the gutter cleaner 100 as seen along Line A-A in FIG. 2. As illustrated, the fan assembly 102 includes a body 122 defining a lumen 124 through which airflow passes. The inlet 108 is illustrated with a tapered sidewall profile. In a particular embodiment, the inlet 108 defines a bellmouth taper. The exit port 110 is illustrated with a tapered sidewall profile. In an embodiment, a largest diameter of the inlet 108 can be at least 30% larger than the smallest diameter of the exit port 110, such as at least 40% larger than the smallest diameter of the exit port 110, such as at least 50% larger than the smallest diameter of the exit port 110. The lumen 124 of the fan assembly 102 can define an aspect ratio [$L/W_{AVG}$], as measured by a length, L, of the lumen 124 as compared to an average width, $W_{AVG}$, of the lumen 124, of at least 1, such as at least 1.25, such as at least 1.5, such as at least 2.

The fan assembly 102 can include a fan 126 disposed at least partially in the lumen 124. In an embodiment, the fan 126 can be rotatably driven by a motor 128. In an embodiment, the motor 128 is disposed at least partially downstream of the fan 126. The motor 128 can include, for example, an electric motor, a gas motor, or a hybrid motor. The motor 128 can be single speed or variable speed to drive the fan 126 at fixed or variable speeds, respectively. In certain instances, the motor 128 can include a soft start whereby the motor gradually ramps up to full speed (e.g., over a duration of 5 seconds). The lumen 124 can further include a stator (not illustrated) disposed downstream of the fan 126. The stator can at least partially remove air swirl generated by the fan 126. In an embodiment, the stator can be fixed relative to the sidewall of the lumen 124.

Figure 4:
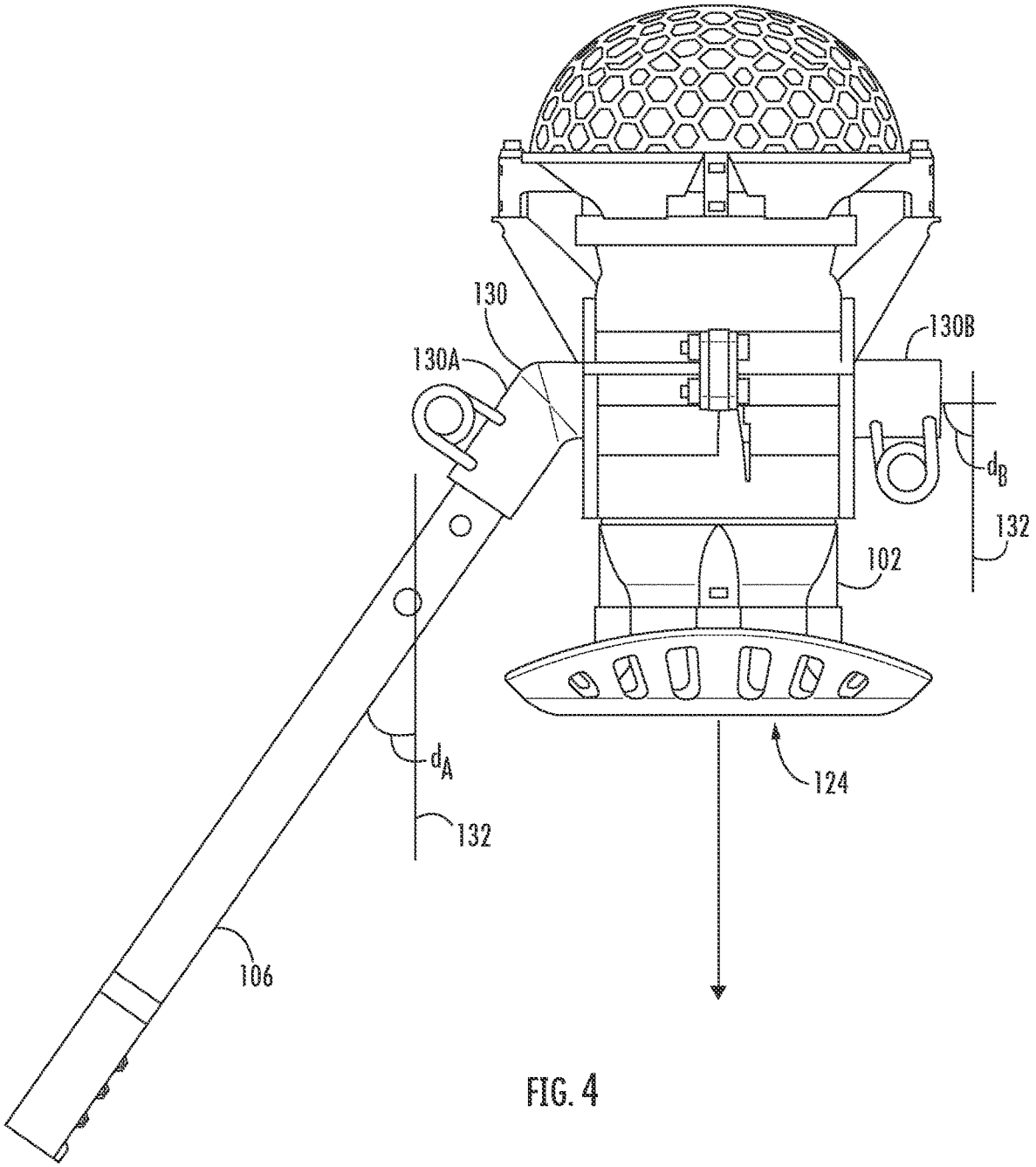
FIG. 4 includes a side view of a gutter cleaner in accordance with one or more embodiments described herein.

Referring to FIG. 4, the handle 106 can be coupled to the fan assembly 102 through a connector 130. The embodiment of the gutter cleaner 100 illustrated in FIG. 4 includes a first connector 130A and a second connector 130B disposed at different angular orientations, a, as measured with respect to a central axis of the lumen 124. The first and second connectors 130A and 130B can be circumferentially spaced apart from one another around the fan assembly 102. In a particular embodiment, the first and second connectors 130A and 130B can be diametrically opposed to one another. The operator can selectively switch between the first and second connectors 130A and 130B based on the characteristics of the gutter to be cleaned, such as for example, the height of the gutter relative to the operator's location, obstacles which might prevent the operator from standing at a particular location below the gutter, and the type of gutters being cleaned. The first and second connectors can be angularly offset from each other, for example, by an angular displacement of at least 15°, such as at least 30°, at least 45°, or at least 60°. In an embodiment, the first connector 130A can have an angular orientation, $\alpha_A$, as measured with respect to a central axis 132 of the lumen 124, in a range of 15° and 75°, such as in a range of 30° and 60°, such as approximately 45°. Meanwhile, the second connector 130B can have an angular orientation, $\alpha_B$, as measured with respect to the central axis 132 of the lumen 124, of approximately 90°. In this regard, the first connector 130A can be angularly offset from the second connector 130B by an angle of approximately 45°, allowing the operator to select an appropriate operational orientation of the fan assembly 102 during operational use.

Figure 5:
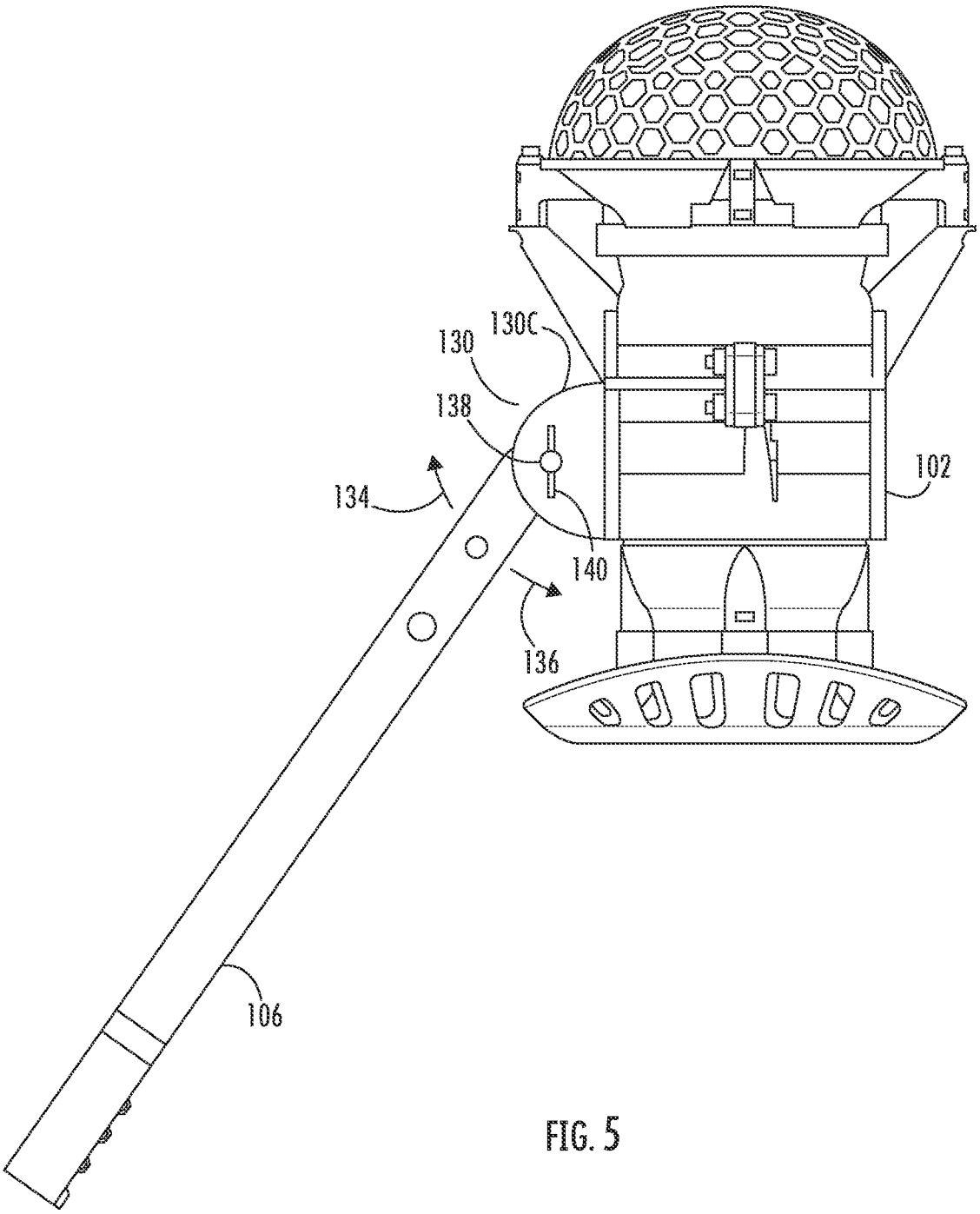
FIG. 5 includes a side view of a gutter cleaner in accordance with one or more embodiments described herein.

Referring to FIG. 5, in an embodiment, the connector 130 between the handle 106 and fan assembly 102 can include an adjustable, interface 130C. The adjustable interface 130C can permit rotation of the handle 106 in either direction indicated by arrows 134 and 136. The interface 130C can include, for example, a pivot axis 138 upon which the handle 106 can rotate and a selectively engageable lock 140 to selectively maintain the handle 106 at a desired rotational angle. The interface 130C can be infinitely adjustable, e.g., selectively maintainable at any rotational orientation within a rotational range, or include a fixed number of selectable rotational orientations. In a non-illustrated embodiment, the interface 130C can include multi-dimensional adjustment, permitting the operator to adjust the yaw of the fan assembly 102 with respect to the handle 106. In certain instances, use of a canted yaw during operation may self-propel the fan assembly 102 along the length of the gutter when the fan 126 is operational. That is, thrust generated by the fan assembly 102 can have an angular component parallel with a length of the gutter, thus creating a force to bias the fan assembly 102 along the gutter.

Referring again to FIG. 6, a third connector 130C is illustrated with a canted yaw whereby the handle 106 engages the fan assembly 102 so as to form an angular component parallel with a length of the gutter. The operator can either stand laterally offset from the fan assembly 102 so as to maintain a vertical orientation of the fan assembly 102, or stand below the fan assembly 102 so as to maintain a canted yaw of the fan assembly 102 with respect to the length of the gutter. The operator can feather (i.e., adjust) between rotational orientations to find a preferred operating angle and to generate a desired angular component of force parallel with the length of the gutter.

Figure 7:
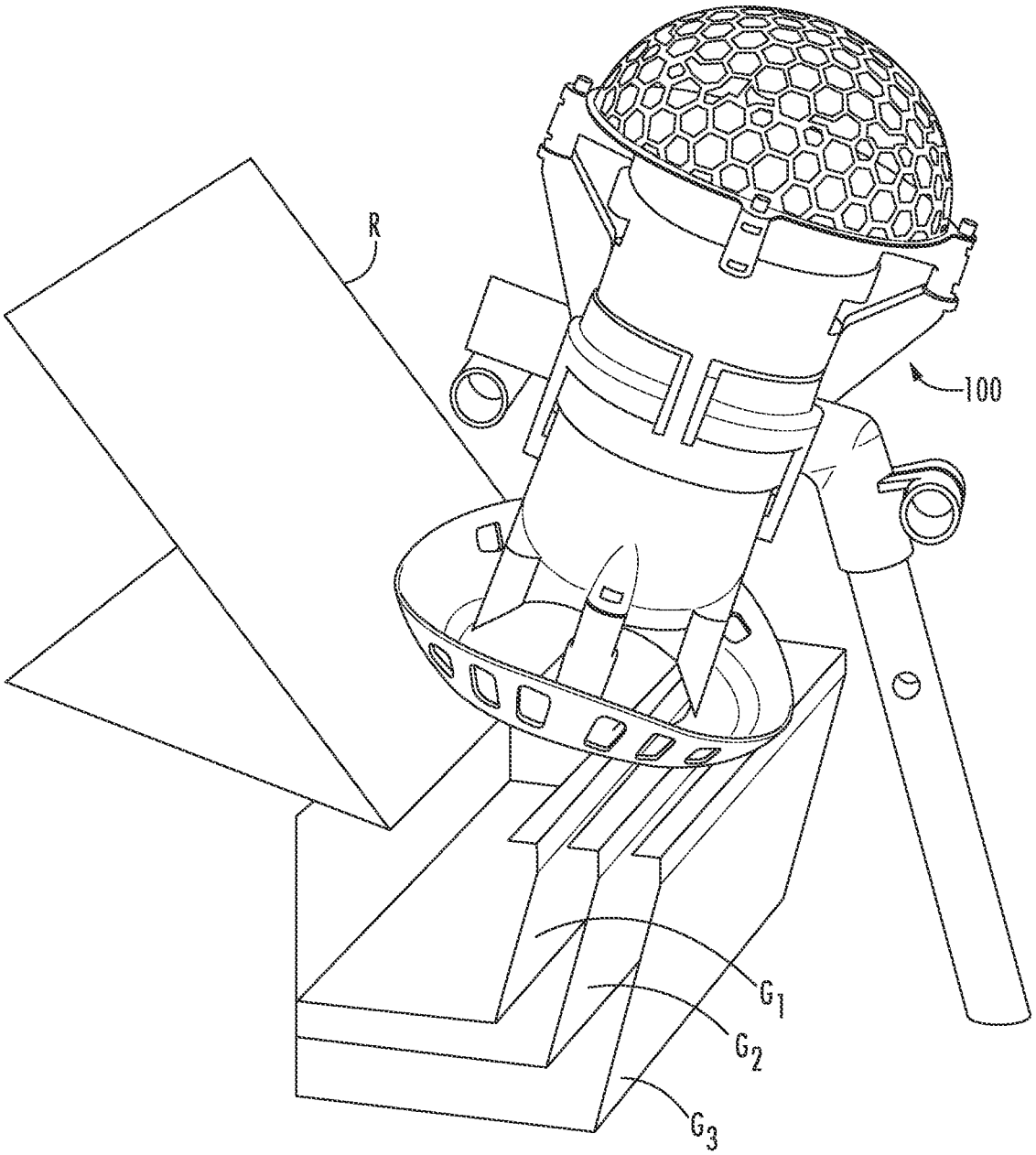
FIG. 7 includes a perspective view of a gutter cleaner used to clean a gutter in accordance with one or more embodiments described herein.

FIG. 7 illustrates the gutter cleaner 100 in use on three gutters $G_1$, $G_2$, and $G_3$. While the gutters $G_1$, $G_2$, and $G_3$ have different dimensions, the guide 104 of the gutter cleaner 100 is sized to remain disposed above all the gutters $G_1$, $G_2$, and $G_3$. That is, the dimensions of the guide 104 are greater than the dimension, e.g., width, of the gutters $G_1$, $G_2$, and $G_3$. In operation, the guide 104 can contact the gutter G1, G2, or G3 and shingles associated with the roof R. The guide 104 can slide therealong while generating airflow to clear debris from the gutter $G_1$, $G_2$, or $G_3$. As illustrated, the gutter cleaner 100 can be operated at a non-vertical angle so that the airflow generated by the fan assembly 102 is angularly offset from a vertical axis. In this case, the gutter cleaner 100 is pitched backward, i.e., toward the building, such that airflow penetrates deeper under the edge of the roof R.

In an embodiment, the gutter cleaner 100 can define an approximately neutral operational buoyancy. Referring to FIGS. 8A through 8D, upthrust 802 generated by the gutter cleaner 100, and more particularly the fan assembly 102 of the gutter cleaner 100, can drive the gutter cleaner 100 upward while the weight 804 of the gutter cleaner 100, and more particularly, the weight of the fan assembly 102, pulls the gutter cleaner 100 downward. The upthrust 802 can be separated into two vectors including a first component 802A generally parallel with the handle 106 and a second component 802B perpendicular to the handle 106. Similarly, the weight 804 can be separated into two vectors including a first component 804A generally parallel with the handle 106 and a second component 804B perpendicular to the handle 106. The vectors in FIGS. 8A through 8D are not necessarily drawn to scale, and are intended to schematically illustrate operational buoyancy as described herein.

Figure 8A:
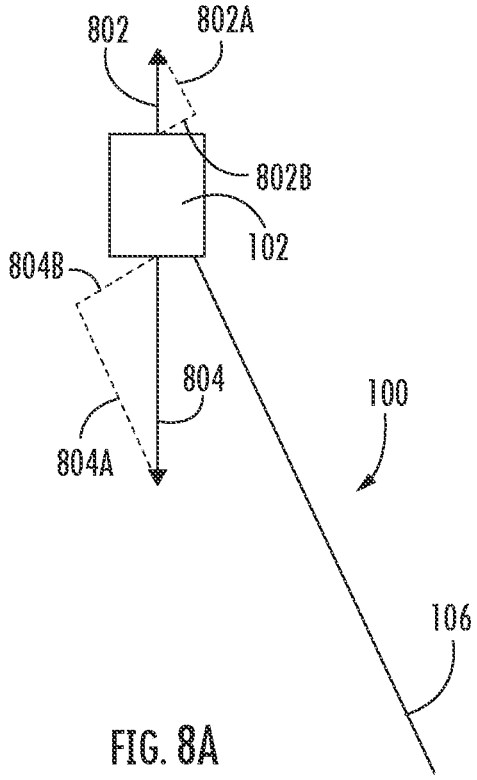
FIGS. 8A to 8D include schematic view of gutter cleaners in accordance with one or more embodiments described herein.
Figure 8B:
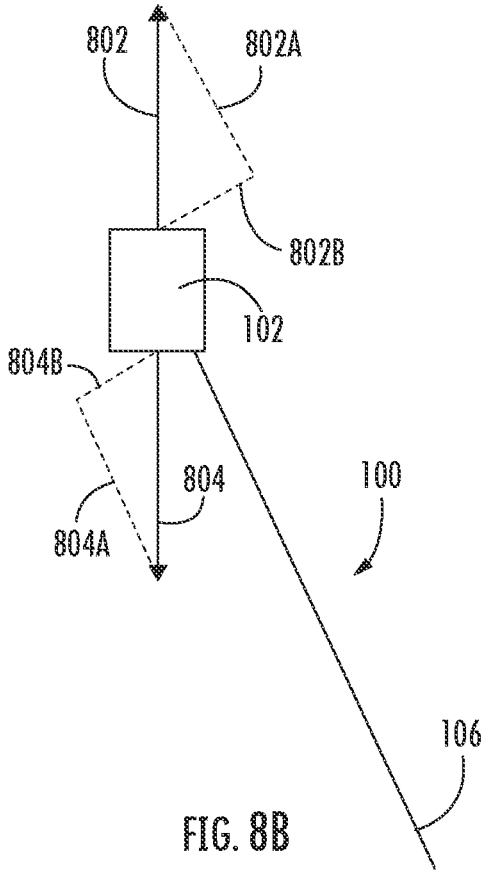
Figure 8C:
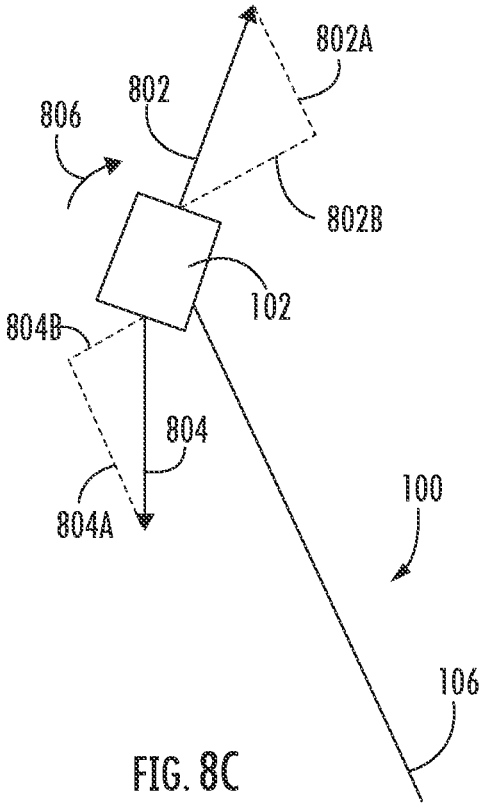
Figure 8D:
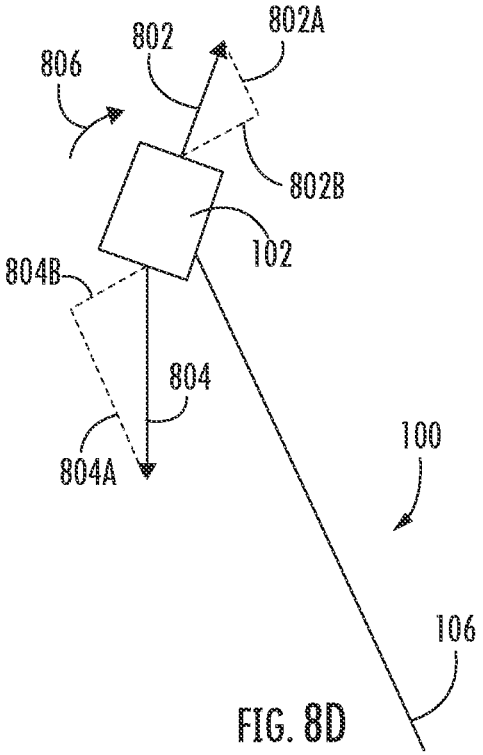

FIGS. 8A and 8B illustrate schematic embodiments of the gutter cleaner 100 with the fan assembly 102 oriented such that airflow from the lumen 124 is oriented vertically downward. FIGS. 8C and 8D illustrates schematic embodiments of the gutter cleaner 100 with the fan assembly 102 angularly offset from the vertical axis.

While the weight components 804A and 804B remain relatively fixed independent of rotational orientation of the fan assembly 102 (as illustrated in FIGS. 8A-8D), upthrust vectors 802 change in accordance with the rotational orientation of the fan assembly 102. That is, for instance, the second component 802B of the upthrust 802 increases when the fan assembly 102 is pitched in a direction corresponding with arrow 806. The second component 802B can correspond with torque created by the fan assembly 102. The resultant torque be transmitted to the operator along the length of the handle 106. As the fan assembly 102 is rotated further in the direction of arrow 806, the torque component of upthrust 802 increases.

FIG. 8A illustrates an operating condition where the fan assembly 102 generates insufficient torque along the second component 802B of the upthrust 802 to create approximately neutral operational buoyancy. That is, the second component 802B of the upthrust 802 is insufficient to overcome the second component 804B of the weight 804. FIG. 8C illustrates an operating condition where the fan assembly 102 generates too much torque along the second component 802B of the upthrust 802 to create an approximately neutral operational buoyancy. The condition illustrated in FIG. 8A results in increased effort required by the operator to hold the gutter cleaner 100 above the gutter while the condition illustrated in FIG. 8C can result in toppling of the gutter cleaner 100 if the torque component 802B accelerates the gutter cleaner 100 in a runaway manner in the direction of arrow 806. Meanwhile FIGS. 8B and 8D illustrate neutral operational buoyancy where the second component 802B (i.e., torque) of upthrust 802 is substantially similar to the second component 804B of the weight of the gutter cleaner 100. It is noted that the required upthrust 802 necessary to generate approximately neutral operational buoyancy is less with a rotated fan assembly 102 (FIG. 8D) as compared to a vertically oriented fan assembly 102 (FIG. 8B).

Neutral operational buoyancy can result in a perceived condition whereby the operator experiences negligible torque from the gutter cleaner 100 in the operational state. That is, the force generated by the fan assembly 102 can effectively cancel out the perceived weight of the gutter cleaner 100. It is noted that the angular orientation and length of the handle 106 can affect the operational buoyancy of the gutter cleaner 100. For instance, long handles 106 at shallow angular orientations may seem heavier than short handles 106 at steep angular orientations. In certain instances, the operator may select an appropriate length of the handle 106 based on the gutter being cleaned. For instance, the operator may lengthen the handle 106 when cleaning second story gutters or for nearby ground that dips below first-floor ground level. Adjusting the length of the handle 106 can be performed in certain embodiments by telescopically or otherwise longitudinally extending the handle 106. In other embodiments, adjusting the length of the handle 106 can be performed by adding and removing segments. The operator can also adjust the angular displacement of the fan assembly 102 by selecting the appropriate connector 130 or connector angle. In certain instances, neutral operational buoyancy may be helpful in lifting the blower from the ground level to the operating position. That is, with a neutral operational buoyancy, it may be easier for the operator to lift the gutter cleaner 100. In this regard, and in accordance with one or more embodiments, an operator may engage the fan assembly 102 prior to raising the gutter cleaner to the gutter.

In an embodiment, operational buoyancy may be determined using the gutter cleaner 100 on a gutter disposed at a one-story elevation with the operator on ground level. In other embodiments, operational buoyancy may be determined at an elevation associated with a second-story, a third story, or anywhere in between ground level and a third story. While operational buoyancy may be theoretically determinable at any vertical elevation, safety and practical considerations may effectively limit test elevation to one, two, or in limited instances—three stories.

To test operational buoyancy, an operator can stand beneath the gutter to be cleaned, or a test area, holding the handle 106 of the gutter cleaner 100. With the fan 126 engaged, the operator can adjust the angle of the handle 106 along at least one of an X- and Y-axis until the perceived torque caused by the second component 804B of the weight 804 of the gutter cleaner 100 is negligible. At this condition, the gutter cleaner 100 may be considered as having approximately neutral operational buoyancy. The operator can then move along the length of the gutter, while generally maintaining the angle of the handle 106, to clean the gutter of debris.

In an embodiment, the gutter cleaner 100 can include a sensor configured to sense a condition of the gutter cleaner 100, such as for example, an angular orientation, velocity, acceleration, etc. of the gutter cleaner 100 vis-à-vis an angular orientation of the handle 106, fan assembly 102, or both. The sensor can communicate the sensed condition to a processor that can monitor for undesirable dispositions, e.g., runaway conditions like shown in FIG. 8C. In one or more embodiments, the processor may further control a variable fan 126 so as to maintain approximately neutral operational buoyancy when the operator adjusts a length or angular orientation of the handle 106 or an angular orientation of the fan assembly 102.

In accordance with one or more embodiments described herein, the gutter cleaner 100 can be driven by an electric motor 128. The electric motor 128 can receive electrical power from a battery, e.g., a removable and/or rechargeable battery, or from a cable plugged into an electrical source, e.g., an electrical outlet. In certain instances, the battery can be disposed at ground level, e.g., within and/or on the handle 106. Electrical connection between the battery and motor 128 can extend through and/or on the handle 106. In an embodiment, In an embodiment, the battery can be at least partially disposed on a harness to be worn or attached to the operator.

In certain instances, the operator can utilize a harness which can engage with the handle 106 and couple the handle 106 to the operator's body. The harness can include, for instance, a waste/torso band and/or shoulder strap which can transfer the weight of the gutter cleaner 100 to the body of the operator without requiring the operator to exert significant force through their hands. In a particular instance, operation of the gutter cleaner 100 can be performed substantially hands-free. For example, with the handle 106 attached to the harness and approximately neutral operational buoyancy achieved, the operator can generally let go of the handle 106 while optionally maintaining hands nearby to guide and support the gutter cleaner 100 along the length of the gutter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A gutter cleaner comprising:

a fan assembly;

a guide configured to at least partially support the fan assembly on a gutter, wherein the guide comprises a skid configured to slide along the gutter;

a handle coupled to the fan assembly at a location adjacent to a first axial end of the handle;

a battery port disposed at a location adjacent to a second axial end of the handle, the second axial end of the handle being opposite the first axial end of the handle; and a processor configured to control a speed of the fan assembly during operation in response to a sensed condition, the sensed condition comprising an angular orientation of at least one component of the gutter cleaner, wherein the gutter cleaner is supportable via the handle by an operator located at an elevation below the gutter, and wherein the gutter cleaner has an approximately neutral operational buoyancy.

2. The gutter cleaner of claim 1, wherein the handle is coupled to the fan assembly through a multi-axis connector comprising at least one of:

an adjustable, multi-axis interface, and at least a first connector and a second connector disposed at different angular orientations.

3. The gutter cleaner of claim 1, wherein a length of the handle is adjustable.

4. The gutter cleaner of claim 1, further comprising an inlet cover disposed upstream of the fan assembly, wherein the inlet cover defines a curved profile.

5. The gutter cleaner of claim 1, wherein the handle is engageable with a harness configured to be coupled to the operator.

6. The gutter cleaner of claim 1, wherein the guide comprises a quick connect interface, and wherein the guide is interchangeable with a plurality of different-style guides.

7. The gutter cleaner of claim 1, wherein the guide comprises a tapered lip.

8. The gutter cleaner of claim 1, wherein the guide is shaped such that the gutter cleaner extends into the gutter by no greater than 10% of a vertical elevation of the gutter.

9. The gutter cleaner of claim 1, wherein the fan assembly includes a fan configured to generate airflow to remove debris from the gutter, wherein the fan assembly is configured to generate airflow at a mass flow rate of at least 0.2 kg/s and velocity of at least 30 m/s during operation.

10. The gutter cleaner of claim 9, wherein the processor is configured to modulate a speed of the fan during operation of the gutter cleaner.

11. The gutter cleaner of claim 1, wherein the gutter cleaner is configured to generate an adjustable, variable speed airflow to blow debris from the gutter.

12. A method of cleaning a gutter with the gutter cleaner of claim 1, the method comprising:

positioning the gutter cleaner adjacent to the gutter;

generating an airflow with the fan assembly; and moving the gutter cleaner along a length of the gutter to blow debris therefrom.

13. The method of claim 12, wherein the step of moving the gutter cleaner is performed by translating the guide along the length of the gutter.

14. The method of claim 12, wherein the step of positioning the fan assembly is performed prior to the step of generating airflow with the fan assembly.

15. The method of claim 12, wherein the step of positioning the fan assembly is performed by pivoting the fan assembly from a first elevation below the gutter to a second elevation above the gutter.

16. The method of claim 12, further comprising:

selecting an angular displacement between the fan assembly and the handle prior to the step of positioning the fan assembly.

17. The method of claim 12, further comprising:

coupling the handle to a harness coupled to an operator of the gutter cleaner.

18. The method of claim 12, further comprising:

selecting an angular orientation of the fan assembly with respect to the handle; and selecting a length of the handle, wherein the selected angular orientation and length of the handle are selectable such that an operator is positioned at a vertical elevation below the gutter.

* * * * *